US005591017A

United States Patent [19]

Dwyer

[11] Patent Number: 5,591,017

[45] Date of Patent: Jan. 7, 1997

[54] MOTORIZED IMPELLER ASSEMBLY

[75] Inventor: Mark K. Dwyer, Burlington, N.C.

[73] Assignee: Ametek, Inc., Kent, Ohio

[21] Appl. No.: 317,174

[22] Filed: Oct. 3, 1994

[51] Int. Cl.[6] ..... F04D 29/58; F04D 29/00

[52] U.S. Cl. ..... 417/366; 417/423.7

[58] Field of Search ..... 417/423.7, 423.8, 417/366; 310/62, 63, 67 R; 416/3

[56] References Cited

U.S. PATENT DOCUMENTS

| | | | |
|---|---|---|---|
| 2,920,574 | 1/1960 | Sampietro | 417/423.7 |
| 3,243,621 | 3/1966 | Wesolowski | 416/3 |
| 4,554,491 | 11/1985 | Plunkett | 310/62 |
| 4,563,622 | 1/1986 | Deavers et al. | 310/62 |
| 4,804,873 | 2/1989 | Shiraki et al. | 310/67 R |
| 5,095,238 | 3/1992 | Suzuki et al. | 310/67 R |
| 5,157,295 | 10/1992 | Stefansky et al. | 310/67 R |
| 5,332,374 | 7/1994 | Kricker et al. | 417/423.7 |
| 5,478,222 | 12/1995 | Heidelberg et al. | 417/423.7 |

*Primary Examiner*—Timothy Thorpe
*Assistant Examiner*—William Wicker
*Attorney, Agent, or Firm*—Renner, Kenner, Greive, Bobak, Taylor & Weber

[57] ABSTRACT

A low profile motorized impeller assembly is provided for use in an air moving blower product. The assembly has a motor mounting base onto which a stator is fixedly attached. An impeller having a plurality of vanes has a ring-magnet rotor integrated therein. A pair of bearings are received in a beating receiving boss in the impeller, and a shaft which is fixedly attached to the motor mounting base is received therein. A plurality of permanent magnets are mounted on the motor mounting base between the arms of the stator so that when the windings of the stator are de-energized the permanent magnets attract the poles of the ring magnet to an offset position.

14 Claims, 2 Drawing Sheets

MOTORIZED IMPELLER ASSEMBLY

TECHNICAL FIELD

The present invention relates to a motorized impeller assembly for use in an air moving blower product. More particularly, the present invention relates to fixed or variable speed blowers used in modulating gas combustion systems for residential water and space heating. Specifically, the invention pertains to a single phase brushless DC motor consisting of a four pole stator and a four pole permanent magnet rotor with an integrated impeller shaft.

BACKGROUND ART

Improvements in gas fired furnaces and boilers have resulted in high efficiency systems in small packages. At the same time, environmental regulations for reduction of combustion byproducts have increased. To cope with both of these conditions, gas appliance manufacturers have requested low cost, low profile induced draft blowers to fit into the smaller volumes, to improve efficiency, and to meet the environmental requirements. A further trend in induced draft blowers will be to provide variable speed capability to allow continuous optimization of combustion and to provide blower systems that are in themselves efficient and that produce low electromagnetic interference.

A single-phase brushless DC motor consisting of a four pole stator and a four pole permanent magnet rotor has been determined to be the most economical motor to satisfy the foregoing requirements. However, a problem common with single phase motor commutation schemes occurs when the windings are de-energized and the motor comes to rest at a magnetically neutral position. This position, where the rotor magnets center themselves about the path of least reluctance, is also the point at which the motor torque constant is zero. Regardless of the current applied to the motor winding, the rotor will remain in the neutral position, and will not start.

Gas regulatory agencies require residential combustion systems utilizing a combustion (or induced draft) air supply blower to include a sensor to confirm that the blower is in operation before the actuation of the gas supply valve. Previously, this has been accomplished by the use of a pressure transducer. The brushless motor control electronics offer a convenient means to confirm operation of the motor and fan, eliminating the need and cost of the pressure transducer. Some regulatory agencies, however, will not recognize operation of the motor as assuring operation of the impeller because of the typical shaft linkage between the motor rotor and the impeller.

There is clearly a need in the art for an integrated motor and impeller assembly for use as an air moving blower product which has a low profile and utilizes a motor with simplified and economical motor commutation electronics and positive starting characteristics.

DISCLOSURE OF THE INVENTION

In light of the foregoing, it is a first aspect of the invention to provide an integrated motor and impeller assembly for use in an air moving blower product.

Another aspect of the invention is the provision of an integrated motor and impeller assembly which has a low profile.

Yet another aspect of the invention is the elimination of the need for a pressure transducer to indicate impeller operation.

Still a further aspect of the invention is to provide an integrated impeller assembly which has positive starting characteristics.

The foregoing and other aspects of the invention which will become apparent as the detailed description proceeds, are achieved by a motorized impeller assembly, comprising: motor mounting means; a stator fixedly attached to said motor mounting means; an impeller; a rotor fixedly integrated with said impeller; means for engaging said impeller with said motor mounting means; and means for parking said rotor in an offset position relative to said stator.

Other aspects of the invention are attained by a low profile motorized impeller assembly, comprising: an annular disc shaped motor mounting base having a shaft receiving aperture and a stator mounting boss; a stator frictionally engaging said stator mounting boss, said stator comprising a plurality of stacked lamination plates, said plates having a plurality of salient arms, said arms including a plurality of windings; an impeller including a main body portion, a plurality of vanes extending upward from said main body portion, a plurality of air ventilation apertures penetrating said main body portion, a rotor receiving boss extending from said main body portion and a bearing receiving boss also extending from said main body portion; a rotor comprised of a four pole ring-magnet, said ring-magnet frictionally engaging said rotor receiving boss; a shaft which frictionally engages said shaft receiving aperture at said motor mounting base; a plurality of bearings mounted in said bearing mounting boss which frictionally engages said shaft so that said impeller may rotate relative to said motor mounting boss; and a plurality of permanent magnets mounted in diametrical opposition from one another on said motor mounting base between said arms of said stator so that when said windings are de-energized said permanent magnets attract said poles of said ring-magnet to an off set position.

Still other aspects of the invention are attained by an impeller motor assembly comprising: a single phase brushless DC motor, having an inner, four pole, wound stator member and an outer four pole ting-magnet rotor member; and a plurality of stationary permanent magnets located adjacent to said rotor member and centered between the poles of said stator, each of said permanent magnets having the same pole closest to the ring magnet motor member and having an energy product large enough to attract the poles of the ring-magnet rotor member away from the poles of the wound stator member when said wound stator member is de-energized, thereby stopping said rotor in a magnetically offset position from which the rotor may be restarted.

BRIEF DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
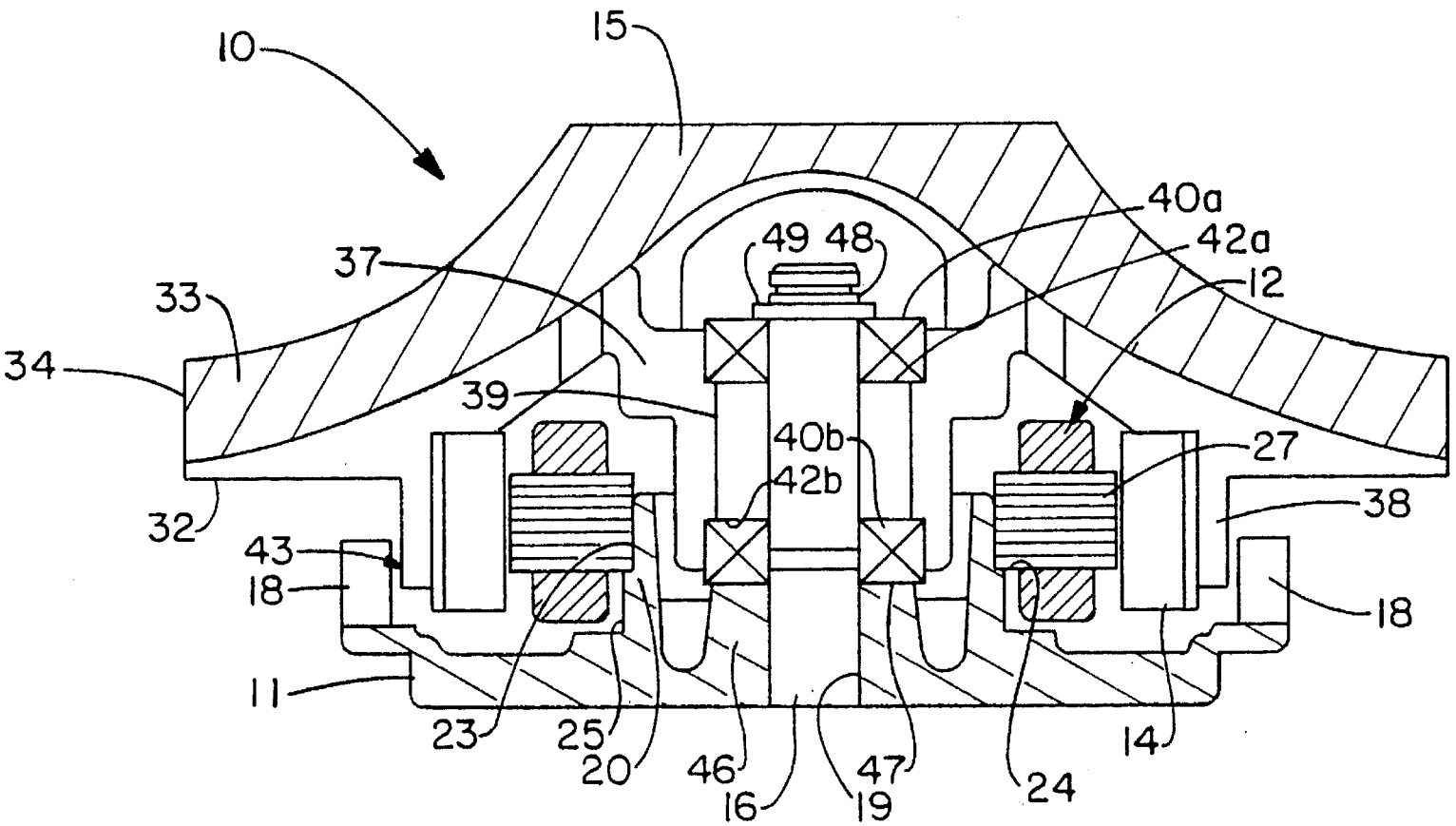
FIG. 1 is an elevational view of the motorized impeller assembly according to the present invention.

Referring now to the drawings and more particularly to FIG. 1, it can be seen that a motorized impeller assembly according to the invention is designated generally by the numeral 10. As can be seen, the assembly 10 is comprised generally of a motor mounting base 11, an inner wound stator member 12, an outer ring-magnet rotor member 14, and a rotating impeller member 15 integrated with the rotor 14.

The assembly 10 is further comprised of a motor shaft 16 and a plurality of stationary permanent magnets 18. As shown, the motor mounting base 11 is a generally annular disc shaped member having a shaft receiving aperture 19 and a stator mounting boss 20. The mounting boss 20 is comprised of a generally circumferential wall 22 which extends from and is perpendicular to the base 11. As can be seen, the circumferential wall 22 surrounds the shaft receiving aperture 19 and has a reduced diameter portion 23 which forms a seat 24 relative to the larger diameter portion 25, against which is seated the stator laminations 27.

Figure 2:
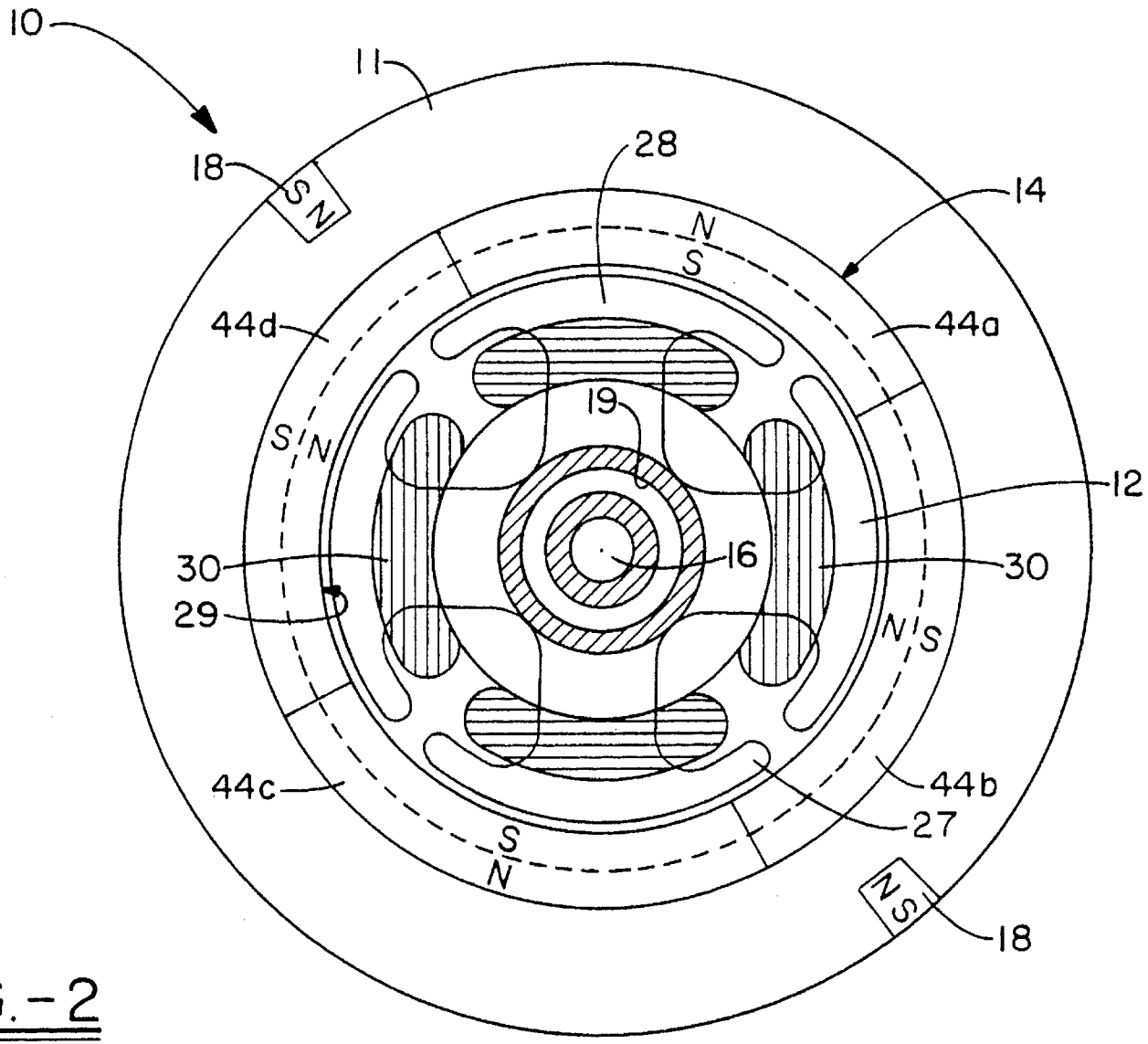
FIG. 2 is a schematic view showing the four pole stator, four pole ring-magnet motor and permanent magnets.

The stator member 12 is comprised of stacked lamination plates 27 which are manufactured such that each plate includes four salient arms 28. This is best shown in FIG. 2. Each arm 28 has an outer periphery 31 on a radius slightly smaller than that of the inside radius 29 of the ring-magnet rotor member 14. Further, each arm 28 of the stator 12 is associated with a winding 30 which when energized causes a temporary magnetization of the stator arms 28. As discussed previously, the stator 12 is seated on the stator mounting boss 20 and positively engages the base 11 by way of an interference fit. The stator 12 thereby remains stationary relative to the base 11. For reasons which will become apparent as the discussion proceeds, the stationary permanent magnets 18 are mounted on the motor base 11. The magnets 18 are diametrically opposed from one another and are located on the outer periphery of the base 11.

Referring again to FIG. 1, it can be seen that the impeller member 15 is comprised of a main body portion 32 having a plurality of vanes 33 extending upwardly therefrom and radiating to the outer periphery 34 of the main body portion 32. A plurality of air ventilation apertures 35 are also included in the main body portion 32 between the vanes 33. The impeller member 15 further includes, on its underside, a bearing receiving boss 37 and a rotor receiving boss 38. The bearing receiving boss 37 is characterized by a circumferential wall 39 which extends orthogonally from the main body portion 32. The circumferential wall 39 is adapted to receive a pair of conventional ball bearings 40A and 40B, which are seated against circumferential bearing seats 42A and 42B respectively, which are formed in the wall 39. The rotor receiving boss 38 is likewise characterized by a circumferential wall 43 which extends orthogonally from the main body portion 32. The wall 43 is of a substantially greater diameter than the bearing receiving boss 37.

A four pole ting-magnet rotor 14 is integrated with the impeller 15 by way of the rotor receiving boss 38 and is permanently affixed thereto. As is best illustrated in FIG. 2, the ting-magnet rotor member 14 is comprised of a magnetic ring which is divided into four equal quadrants 44. Each quadrant 44 essentially represents an individual magnet having a north pole and a south pole. It can be seen that the separate poles run the length of the quadrant one on the inside circumference of the ring and the other on the outside circumference. Further, the position of the north and south pole respectively alternates from one quadrant to the next. For example, with respect to the quadrant 44A the north pole lies along the outer circumference of the ring-magnet 14 while the south pole lies along the inner circumference of the ring-magnet rotor 14, while the adjacent quadrants 44B and 44D each have their north poles disposed along the inner circumference and their south poles disposed along the outer circumference. As such the ring-magnet rotor member 14 has four distinct inner circumferential poles.

The impeller assembly 15 is mounted to the base 11 via a shaft member 16 which penetrates the shaft receiving aperture 19 and is affixed thereto by way of an interference fit. As can be seen in FIG. 1, the shaft receiving aperture 19 is defined by a circumferential wall 46, which forms a bearing seat 47 relative to the shaft 16. The bearings 40 which have been previously secured in the bearing receiving boss 37 of the impeller 15 may be pressed onto the reduced diameter portion 45 of the shaft 16 and secured thereto by a retaining ring 48. As such axial movement of the impeller 15 relative to the base 11 is severely restricted, as the bearing 40B is interposed between the bearing seat 42B of the bearing receiving boss 37 and the bearing seat 47 of the wall 46. Similarly, the bearing 40A is interposed between the retaining ring 48 and the bearing seat 42A of the bearing receiving boss 37. The impeller 15 is thereby fixedly secured to the shaft 16 and may rotate freely thereon.

A spring washer 49 may be employed to pre-load the inner races of the bearings 40. By interposing the spring washer 49 between the retaining ring 48 and the bearing 40A, the inner races are free to move axially on the shaft. The need for precision machine bores for the outer races in the bearing receiving boss 37 is thereby eliminated. The impeller 15 may thus be manufactured as either a cast or molded part.

Those skilled in the art will recognize that the above described device which utilizes a simple brushless DC motor results in a motorized impeller assembly which has a very low profile and may be employed in situations where size and space considerations are critical such as the current compact gas appliances. Further, the use of brushless single phase DC motors is facilitated by the four pole ring-magnet rotor and the stationary permanent magnets 18. As discussed above, the permanent magnets 18 are positioned at the centers of the stator slots. Further, the magnets 18 are situated such that each magnet 18 has the same pole, i.e. north, proximal to the ring-magnet rotor 14. The energy product of the permanent magnets 18 is large enough so that when the stator windings are de-energized the magnets 18 will attract either the south pole or the north pole of the rotor magnet 14 away from the neutral position created by the stator arms 28. As the rotor 14 comes to rest, the magnetic poles will always be offset from the center of the stator arms 28 in the same direction, thereby providing a positive start condition. While in the preferred embodiment described herein, only two permanent magnets 18 are depicted and described. Those skilled in the art will recognize that a greater number of magnets 18 could be employed. For example, it would be possible to use four magnets 18 by placing one each at each of the centers of the stator slots.

Those skilled in the art will also recognize that because the ring-magnet rotor 14 is integrated with the impeller 15 the conventional linkage is eliminated. Therefor, impeller operation is indicated by operation of the motor, thereby eliminating the need for pressure transducers, or the like, to indicate impeller operation. With this design, regulatory agencies will allow the use of the motor control electronics to confirm rotation of the impeller.

It should also be noted that because the stator 12 is located inside the impeller assembly directly under the impeller 15, stator cooling is achieved by the diversion of air through the ventilation apertures 35 to the stator windings 30, thereby eliminating the need for an auxiliary cooling fan.

Thus it can be seen that the objects of the invention have been satisfied by the structure presented above. While in accordance with patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. A low profile motorized impeller assembly, comprising:

motor mounting means comprising an annular disc shaped motor mounting base having a shaft receiving aperture and a stator mounting boss;

a stator fixedly attached to said motor mounting means;

an impeller;

a rotor fixedly integrated with said impeller;

means for engaging said impeller with said motor mounting means comprising a shaft frictionally engaging said shaft receiving aperture of said motor mounting base, a bearing receiving boss, and a plurality of bearings mounted in said bearing mounting boss frictionally engaging said shaft so that said impeller may rotate relative to said motor mounting base; and means for parking said rotor in an offset position relative to said stator.

2. A motorized impeller assembly according to claim 1, wherein said impeller is integrated with said rotor such that rotation of said rotor relative to said stator assures corresponding rotation of said impeller.

3. A motorized impeller assembly according to claim 1, wherein said impeller is integrated with said rotor such that rotation of said rotor relative to said stator assures corresponding rotation of said impeller.

4. A motorized impeller assembly according to claim 1, wherein said stator frictionally engages said stator mounting boss.

5. A motorized impeller assembly according to claim 4, further comprising a retaining ring to maintain said bearings on said shaft and spring means are interposed between said retaining ring and said bearings.

6. A motorized impeller assembly according to claim 1, wherein said impeller includes a main body portion, a plurality of vanes extending upward from said main body portion, a plurality of air ventilation apertures penetrating said impeller body between said vanes, a rotor receiving boss extending from said main body portion and a bearing receiving boss also extending from said main body portion.

7. A motorized impeller assembly according to claim 6, wherein said air ventilation apertures provide cooling to said stator windings.

8. A motorized impeller assembly according to claim 1, wherein said stator is comprised of a plurality of cross-shaped stacked lamination plates having a plurality of salient arms, said arms including a plurality of windings.

9. A motorized impeller assembly according to claim 8, wherein said impeller comprises a rotor receiving boss and said rotor is comprised of a four pole ring-magnet, said ring-magnet frictionally engaging said rotor receiving boss.

10. A motorized impeller assembly according to claim 9, wherein said means for parking said rotor in an offset position relative to said stator is comprised of a plurality of permanent magnets mounted on said motor mounting base between said arms of said stator, so that when said windings are de-energized said permanent magnets attract said poles of said ring magnet to an offset position.

11. A low profile motorized impeller assembly, comprising:

an annular disc shaped motor mounting base having a shaft receiving aperture and a stator mounting boss;

a stator frictionally engaging said stator mounting boss, said stator comprising a plurality of stacked lamination plates, said plates having a plurality of salient arms, said arms including a plurality of windings;

an impeller including a main body portion, a plurality of vanes extending upward from said main body portion, a plurality of air ventilation apertures penetrating said main body, a rotor receiving boss extending from said main body portion and a bearing receiving boss also extending from said main body portion;

a rotor comprised of a four pole ring-magnet, said ring-magnet frictionally engaging said rotor receiving boss;

a shaft which frictionally engages said shaft receiving aperture at said motor mounting base;

a plurality of bearings receiving in said bearing mounting boss which frictionally engage said shaft so that said impeller may rotate relative to said motor mounting base; and a plurality of permanent magnets mounted on said motor mounting base between said arms of said stator so that when said windings are de-energized said permanent magnets attract said poles of said ring magnet to an offset position.

12. A low profile motorized impeller assembly, comprising:

motor mounting means comprising an annular disc shaped motor mounting base having a shaft receiving aperture and a stator mounting boss;

a stator fixedly attached to said motor mounting means;

an impeller;

a rotor fixedly integrated with said impeller;

means for engaging said impeller with said motor mounting means;

a retaining ring maintaining said bearings on said shaft and spring means interposed between said retaining ring and said bearings; and means for parking said rotor in an offset position relative to said stator.

13. A low profile motorized impeller assembly, comprising: motor mounting means;

a stator fixedly attached to said motor mounting means;

an impeller;

a rotor fixedly integrated with said impeller;

means for engaging said impeller with said motor mounting means;

means for parking said rotor in an offset position relative to said stator; and wherein said impeller includes a main body portion, a plurality of vanes extending upward from said main body portion, a plurality of air ventilation apertures penetrating said impeller body between said vanes, a rotor receiving boss extending from said main body portion and a bearing receiving boss also extending from said main body portion.

14. A motorized impeller assembly according to claim 3 wherein said air ventilation apertures provide cooling to said stator windings.

* * * * *